US007370557B2

(12) United States Patent
Marxrieser

(10) Patent No.: US 7,370,557 B2
(45) Date of Patent: May 13, 2008

(54) BOTTLE OPENER WITH CAP STORAGE AND REPLACEMENT CAPABILITIES

(76) Inventor: Gerhard Marxrieser, 1520 Pine Grove La., Chesapeake, VA (US) 23321

( * ) Notice: Subject to any disclaimer, the term of this patent is extended or adjusted under 35 U.S.C. 154(b) by 832 days.

(21) Appl. No.: 10/326,128

(22) Filed: Dec. 23, 2002

(65) Prior Publication Data

US 2003/0164070 A1 Sep. 4, 2003

Related U.S. Application Data

(60) Provisional application No. 60/341,754, filed on Dec. 21, 2001.

(51) Int. Cl.
*B67B 7/16* (2006.01)
*B67B 7/00* (2006.01)

(52) U.S. Cl. ..... 81/3.4; 81/3.08

(58) Field of Classification Search ..... 81/3.07, 81/3.08, 3.29, 3.4, 3.41; D8/18, 33, 40
See application file for complete search history.

(56) References Cited

U.S. PATENT DOCUMENTS

| | | | | |
|---|---|---|---|---|
| 1,207,560 A | | 12/1916 | Keeran | |
| 1,944,310 A | * | 1/1934 | Wagner | 81/3.08 |
| 1,952,660 A | | 3/1934 | Dryden | |
| 2,514,565 A | * | 7/1950 | Capriccio | 81/3.55 |
| 2,514,566 A | * | 7/1950 | Capriccio | 53/363 |
| 3,038,178 A | | 6/1962 | Schumacher | |
| D193,899 S | | 10/1962 | Harrison | |
| 3,600,982 A | | 8/1971 | Tholen | |
| 3,812,741 A | | 5/1974 | Heine | |
| D261,854 S | | 11/1981 | Nielsen | |
| 4,337,678 A | | 7/1982 | Mumford | |
| 4,414,865 A | | 11/1983 | Brooks et al. | |
| 4,433,597 A | * | 2/1984 | Rowland | 81/3.09 |
| 4,455,894 A | | 6/1984 | Roberts | |
| D277,160 S | | 1/1985 | Antone | |
| D278,406 S | | 4/1985 | Koziol | |
| D280,594 S | | 9/1985 | Dow | |
| D281,051 S | | 10/1985 | Nielsen | |
| D281,572 S | | 12/1985 | Gabriel et al. | |
| D291,052 S | * | 7/1987 | Henshaw | D8/40 |

(Continued)

FOREIGN PATENT DOCUMENTS

DE 4113167 A1 * 10/1992

(Continued)

*Primary Examiner*—David B Thomas
(74) *Attorney, Agent, or Firm*—Bacon & Thomas, PLLC

(57) ABSTRACT

A symmetrical, one-piece, aesthetically and ergonomically pleasing bottle opener and re-capping device is made up of a main body having a substantially annular shape, the central opening of the annulus having a substantially cylindrical shape with inwardly extending flanges at each end, the first inwardly extending flange having a planar, axially-inward facing first surface for engaging a lower surface of a bottle cap, and a curved or inclined second surface opposite the first surface for enabling the opener to be snapped over the bottle cap into a position at which the first surfaces can be caused to engage the lower edge of the bottle cap, and the second inwardly extending flange having a substantially planar axially-inward facing surface that engages the top of the bottle cap to retain the cap following removal and to apply pressure to the top of the bottle cap during re-capping.

9 Claims, 2 Drawing Sheets

U.S. PATENT DOCUMENTS

| | | | | | |
|---|---|---|---|---|---|
| 4,702,129 | A | | 10/1987 | Allen | |
| 4,760,763 | A | | 8/1988 | Trick et al. | |
| 5,022,288 | A | | 6/1991 | Taktakian | |
| D347,776 | S | * | 6/1994 | Brix-Hansen | D8/40 |
| D381,881 | S | * | 8/1997 | Shaul et al. | D8/40 |
| D390,433 | S | | 2/1998 | Miller | |
| D407,283 | S | | 3/1999 | Schwab | |
| 6,105,468 | A | * | 8/2000 | Fohrman et al. | 81/3.09 |
| D440,134 | S | | 4/2001 | Brix-Hansen | |
| D442,449 | S | | 5/2001 | McQuillan | |
| 6,640,665 | B1 | * | 11/2003 | Williamson | 81/3.4 |

FOREIGN PATENT DOCUMENTS

| | | | |
|---|---|---|---|
| GB | 2096111 | A * | 10/1982 |
| JP | 07069395 | | 3/1995 |

* cited by examiner

BOTTLE OPENER WITH CAP STORAGE AND REPLACEMENT CAPABILITIES

This application claims the benefit of Provisional U.S. Patent Application Ser. No. 60/341,754, filed Dec. 21, 2001.

BACKGROUND OF THE INVENTION

1. Field of the Invention

This invention relates to a bottle opener of the type used to remove standard bottle caps.

More specifically, the invention relates to a bottle opener capable of removing standard bottle caps, and that is arranged to conveniently store and replace the removed bottle caps.

By standard bottle caps is meant crimped or screw-type bottle caps that engage a lip on the neck of a bottle, and that may either be deformed or grasped-and-twisted in order to permit the cap to clear the lip during removal of the cap. Such caps are normally made of metal and applied to glass bottles containing beverages such as beer or soda, or imported liquid condiments such as soy sauce, although the principles of the invention may be applied to caps other than the standard types of bottle caps described above, and bottles other than glass beverage or sauce containers.

In addition, the opener of the invention may be used to facilitate lifting of lift tabs on easy-open cans, such as aluminum beverage cans.

2. Description of Related Art

U.S. Pat. No. 3,038,178 (Schumacher) discloses a bottle cap removing and recapping device for crimped type bottle caps that permits removal of a bottle cap in the manner of a standard bottle opener, and that also permits recapping by applying pressure to the device upon positioning of the device over a bottle.

The device disclosed in the Schumacher patent is similar to that of the present invention, but differs in at least two respects: First, removal is accomplished by a narrow hook-like spring member extending from the side of a central opening in the device and, second, pressure for re capping is applied by a resilient washer backed by a rigid lining.

The use of a narrow spring member to hook the underside of the bottle cap, and a separate resilient member to apply pressure during re-capping, is disadvantageous for a number of reasons, including increased assembly costs associated with the four separate pieces required in the Schumacher device, reduced reliability and increased risk of breakage due to the relative weakness of the narrow spring member that hooks the bottle cap, and difficulty in using the device because of the need to align the hook member opposite the point which is to serve as fulcrum during removal of the bottle cap.

SUMMARY OF THE INVENTION

It is a accordingly a first objective of the invention to provide a bottle opener capable not only of removing a bottle cap, but also re capping the bottle, and yet that is constructed of one piece and that has a complete symmetrical, user friendly design than the bottle opener and re-capper described in U.S. Pat. No. 3,038,178.

More generally, it is a second objective of the invention to provide a bottle opener having a more ergonomic design than the standard bottle opener.

It is a third objective of the invention to provide a bottle opener that can open traditional caps or screw (twist) off caps with ease and without distorting the caps.

It is a fourth objective of the invention to provide a bottle opener that not only opens bottles, but that can close bottles for later use.

It is a fifth objective of the invention to provide a bottle opener lacking sharp corners, to facilitate handling and storage, and to enhance safety by eliminating the risk that a person will be cut by intentional or accidental contact (for example, by stepping on the opener at pool side, or when handled by a terrorist on an airplane).

It is a sixth objective of the invention to provide a bottle opener that includes magnets to enable storage on a refrigerator or other metallic surface.

It is a seventh objective of the invention to provide a bottle opener that can easily be secured to a key chain or other attachment, such as a belt coupling to enable bartenders to hook the opener to their belts.

It is a eighth objective of the invention to provide a bottle opener having an attractive appearance.

It is an ninth objective of the invention to provide a bottle opener capable of being manufactured using any of a wide variety of different materials, including by way of example and not limitation: titanium, various corrosion resistant alloys, graphite, and composites such as Kevlar.

It is a tenth objective of the invention to provide a bottle opener that may also be used to safely facilitate lifting of non-removable tabs on easy-open cans.

These objectives are achieved by providing a bottle opener having a substantially annular shape, the central opening having a substantially cylindrical shape with inwardly extending flanges at each end, the first inwardly extending flange having a planar, axially-inward facing first surface for engaging a lower surface of a bottle cap, a curved or inclined second surface opposite the first surface for enabling the opener to be snapped over the bottle cap into a position at which the first surfaces can be caused to engage the lower edge of the bottle cap, and the second inwardly extending flange having a substantially planar axially-inward facing surface that engages the top of the bottle cap to retain the cap following removal and to apply pressure to the top of the bottle cap during replacement of the cap on a bottle.

To facilitate lifting of tabs on cans of the type typically used to store soda or beer, and in which lifting of the tab causes a section of the lid defined by a relatively thin perimeter to break and expose the contents of the can, the preferred opener may further include an inwardly facing wall adjacent a radially outer surface of the opener, the wall intersecting the outer surface of the opener at a sufficient angle to enable the opener to hook under the tab and lift the tab when the opener is pivoted in an appropriate direction.

DETAILED DESCRIPTION OF THE PREFERRED EMBODIMENTS

Figure 1:
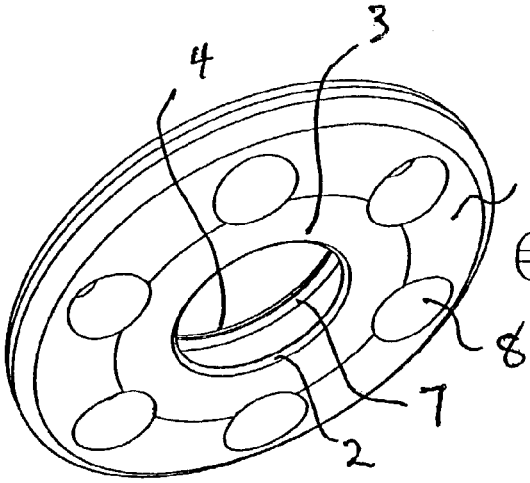
FIG. 1 is an isometric view of a bottle opener constructed in accordance with the principles of a preferred embodiment of the invention.
Figure 4:
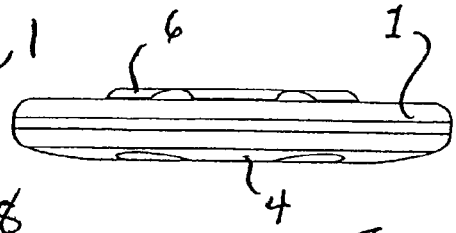
FIG. 4 is an upside-down side elevation of the bottle opener of FIG. 1.
Figure 3:
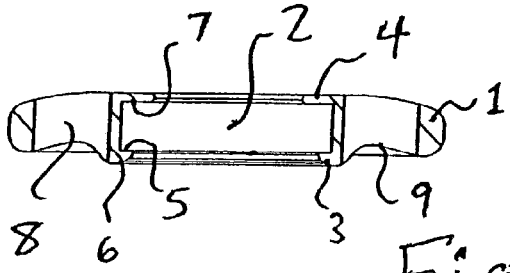
FIG. 3 is a cross-sectional side view taken along line 3-3 in FIG. 2.
Figure 2:
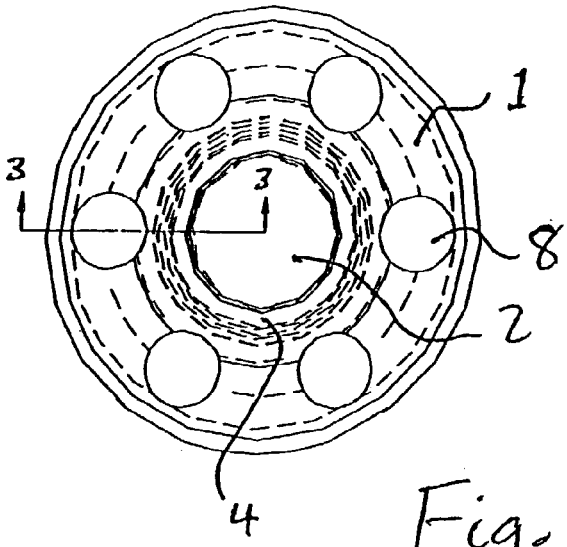
FIG. 2 is a plan view of the bottle opener of FIG. 1.

As illustrated in FIGS. 1-6, the bottle opener of a preferred embodiment of the invention includes a substantially annular member 1 having a cylindrical central opening 2. Respective upper and lower flanges 3 and 4 extend radially inwardly from the member 1 at each of opening 2.

The first inwardly extending flange 3 includes a planar, axially-inward facing first surface 5 for engaging a lower surface of a bottle cap. Flange 3 also includes a curved or inclined second surface 6 opposite the first surface. Second surface 6 slopes inwardly and upwardly from the lowest edge of member 1 for enabling the opener to be snapped over the bottle cap into a position at which the first surfaces can be caused to engage the lower edge of the bottle cap.

The second inwardly extending flange 4 includes a substantially planar axially-inward facing surface 7 that engages the top of the bottle cap to retain the cap following removal and to apply pressure to the top of the bottle cap during replacement of the cap on a bottle. The opposite surface of flange 4 does not have a function related to bottle opening, although in the preferred embodiment it is smooth and flush with the upper surface of member 1 so as to optimize comfort and provide a sleek and attractive appearance.

In the illustrated embodiment, a plurality of openings 8 are included to accommodate magnets that can be used to enable storage of opener on a refrigerator or other metal surface. Alternatively, the openings can be provided to enable a key ring or other attachments to be secured to the opener. For example, opener could be attached to a coupler that enables the opener to be hung from the belt of a bartender or other heavy user.

As illustrated, the smooth annular shape is broken by an annular indentation or groove 9 on the lower side of member 1, for accommodating the fingertips of a user in order to provide a more secure grip when removing a cap.

Normally, during use, the first surface 3 of a portion of flange 2 on one side of the opener will be slid horizontally under the cap, thereby serving as a fulcrum to permit the opposite-side portion of the flange to be snapped over the opposite side of the cap. The act of snapping the opposite-side portion of the flange into place may provide sufficient leverage to at least partially deform and clear the lip on the first side, or the act of removal may begin when both sides of flange 2 are positioned under the rim of the cap, so that maximal leverage can be applied by a combination of surface 4 on one side and surface 2 on the diametrically opposite side of the cap.

The opener illustrated in FIGS. 1-4 may be formed, by casting, machining, or any other suitable method, in one piece, although it is possible to include various appurtenances, such as the above-described magnets, on the main body. The material of the body may be metal, plastic, ceramic, or any other material having sufficient hardness to survive the forces associated with repeated cap removal and re-capping, including exotic materials such as titanium, which may further be covered with a coating to enhance texture, feel, or appearance. Although the opener preferably has a completely symmetric central opening, the inner and outer perimeters of the may depart slightly from the above-mentioned annular shape. For example, the annulus may actually be a 20-sided polygon.

In a variation of the opener of FIGS. 1-4, which may include any of the features and variations described above, the opener is adapted to facilitate lifting of a tab 11 on a can 12 of the type typically used to store soda or beer, and in which lifting of the tab 11 causes a section 14 of the lid, defined by a relatively thin perimeter, to break and expose the contents of the can. The conventional way to open such cans is to hook ones fingernails under the tab, which can cause breakage of fingernails and is difficult for persons with very short fingernails. In addition, a fairly large force must be applied in order to break the perimeter of the section to be opened, which can be difficult for children and elderly persons.

Figure 5A:
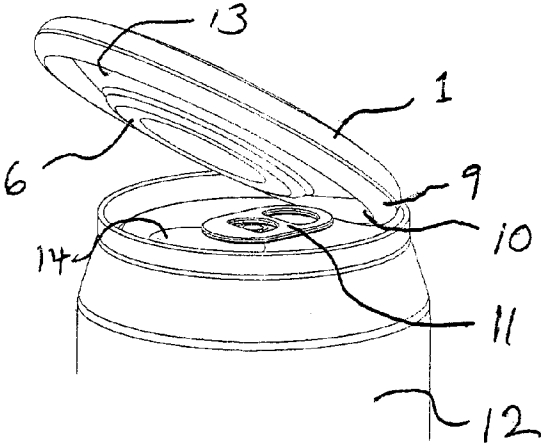
FIG. 5 shows a version of the opener of FIGS. 1-4 having an edge arranged to facilitate lifting of pull-tabs on cans.
Figure 5B:
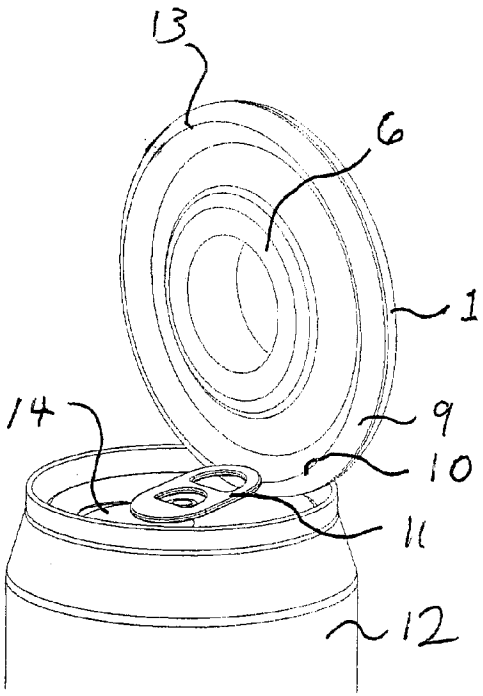
Figure 5C:
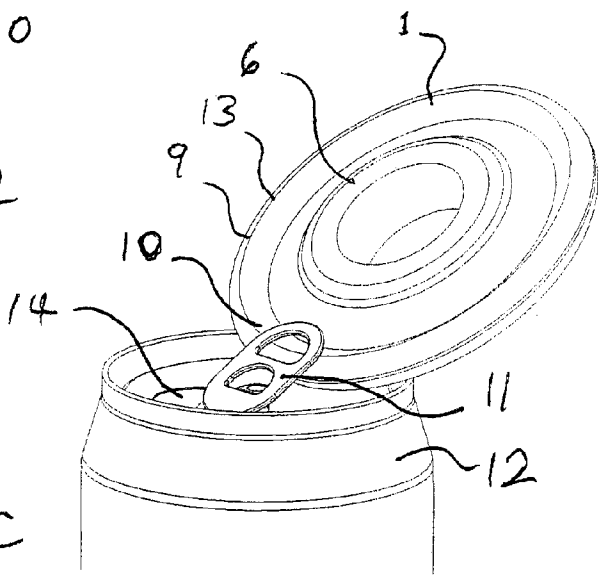

In this embodiment, an inwardly facing wall 10 is formed adjacent the outer surface 9 of the opener, the wall 10 intersecting the outer surface 9 of the annular member 1 at an edge 13. By selecting an appropriate angle for edge 13, the opener may be hooked under the tab 11 to lift the tab when the opener is pivoted in an appropriate direction, as shown in FIGS. 5A-5C, thereby greatly increasing the leverage that can be applied to the tab and facilitating opening.

Having thus described a preferred embodiment of the invention in sufficient detail to enable those skilled in the art to make and use the invention, it will nevertheless be appreciated that numerous variations and modifications of the illustrated embodiment may be made without departing from the spirit of the invention, and it is intended that the invention not be limited by the above description or accompanying drawings, but that it be defined solely in accordance with the appended claims.

What is claimed is:

1. A bottle opener having a substantially annular shape, comprising:

a substantially annular member including a central opening, the central opening having a substantially cylindrical shape and an axis; and a first inwardly extending bottom flange and a second inwardly extending top flange at axially opposite ends of the central opening, wherein the first inwardly extending bottom flange has a planar, axially-inward facing first surface that extends radially inwardly on opposite sides of the opening for engaging a lower surface of a bottle cap, and a curved or inclined second surface opposite the first surface for enabling the opener to be snapped over the bottle cap into a position at which the first surface can be caused to engage the lower edge of the bottle cap to facilitate removal of the cap, and at which the first surface engages opposite sides of the lower edge of the bottle cap to retain the cap between the first and second inwardly extending flanges, wherein the second inwardly extending flange has a substantially planar axially-inward facing surface that engages the top of the bottle cap to retain the cap following removal and to apply pressure to the top of the bottle cap during replacement of the cap on a bottle, and wherein the opener further includes an inwardly facing wall adjacent an radially outer surface of the opener, the wall intersecting the radially outer surface of the opener at a sufficient angle to enable the opener to hook under a pull-tab of a can and lift the tab when the opener is pivoted in an appropriate direction.

2. A bottle opener as claimed in claim 1, wherein the substantially annular member includes at least one opening including a magnet arranged to enable the bottle opener to be magnetically attached to a metal object.

3. A bottle opener as claimed in claim 1, wherein the substantially annular member includes at least one opening arranged to enable an attachment ring to be secured to the opener.

4. A bottle opener as claimed in claim 1, wherein the opener is made of a single piece of formed metal.

5. A bottle opener as claimed in claim 1, wherein the substantially annular member has a smooth annular shape.

6. A bottle opener as claimed in claim 1, wherein thesmooth annular shape lacks sharp edges to reduce a risk of a person being cut by sharp edges on the opener.

7. A bottle opener as claimed in claim 1, wherein the bottle opener is made of a material selected from the group consisting of titanium, corrosion resistant alloys, graphite, and composites.

8. A bottle opener having a substantially annular shape, comprising:

a substantially annular member including a central opening, the central opening having a substantially cylindrical shape and an axis: and a first inwardly extending bottom flange and a second inwardly extending top flange at axially opposite ends of the central opening, wherein the first inwardly extending bottom flange has a planar, axially-inward facing first surface that extends radially inwardly on opposite sides of the opening for engaging a lower surface of a bottle cap, and a curved or inclined second surface opposite the first surface for enabling the opener to be snapped over the bottle cap into a position at which the first surface can be caused to engage the lower edge of the bottle cap to facilitate removal of the cap, and at which the first surface engages opposite sides of the lower edge of the bottle cap to retain the cap between the first and second inwardly extending flanges, wherein the second inwardly extending flange has a substantially planar axially-inward facing surface that engages the top of the bottle cap to retain the cap following removal and to apply pressure to the top of the bottle cap during replacement of the cap on a bottle, and wherein the substantially annular member includes an annular indentation on a lower side for accommodating fingertips of a user.

9. A bottle opener having a substantially annular shape, comprising:

a substantially annular member including a central opening, the central opening having a substantially cylindrical shape and an axis; and a first inwardly extending bottom flange and a second inwardly extending top flange at axially opposite ends of the central opening, wherein the first inwardly extending bottom flange has a planar, axially-inward facing first surface that extends radially inwardly on opposite sides of the opening for engaging a lower surface of a bottle cap, and a curved or inclined second surface opposite the first surface for enabling the opener to be snapped over the bottle cap into a position at which the first surface can be caused to engage the lower edge of the bottle cap to facilitate removal of the cap, and at which the first surface engages opposite sides of the lower edge of the bottle cap to retain the cap between the first and second inwardly extending flanges, wherein the second inwardly extending flange has a substantially planar axially-inward facing surface that engages the top of the bottle cap to retain the cap following removal and to apply pressure to the top of the bottle cap during replacement of the cap on a bottle, and wherein the substantially annular member has a polygonal perimeter.

* * * * *